US009175859B2

(12) United States Patent
Han et al.

(10) Patent No.: US 9,175,859 B2
(45) Date of Patent: Nov. 3, 2015

(54) BURNER ASSEMBLY

(71) Applicant: General Electric Company, Schenectady, NY (US)

(72) Inventors: Bai Han, Chadds Ford, PA (US); Paul Bryan Cadima, Prospect, KY (US); Pranshu Saxena, Madhya Pradesh (IN)

(73) Assignee: General Electric Company, Schenectady, NY (US)

( * ) Notice: Subject to any disclaimer, the term of this patent is extended or adjusted under 35 U.S.C. 154(b) by 401 days.

(21) Appl. No.: 13/688,730

(22) Filed: Nov. 29, 2012

(65) Prior Publication Data

US 2014/0144424 A1 May 29, 2014

(51) Int. Cl.

| | |
|---|---|
| ***F24C 15/00*** | (2006.01) |
| ***F23D 14/14*** | (2006.01) |
| *F24C 3/08* | (2006.01) |

(52) U.S. Cl.

CPC ..... *F24C 15/002* (2013.01); *F23D 14/14* (2013.01); *F24C 3/087* (2013.01)

(58) Field of Classification Search

CPC ..... F24C 15/002; F24C 15/16; F24C 3/087; F24C 3/045; F23D 14/14; F23D 14/10

See application file for complete search history.

(56) References Cited

U.S. PATENT DOCUMENTS

| | | | | |
|---|---|---|---|---|
| 1,998,257 | A | 4/1935 | Smith | |
| 2,004,024 | A | 6/1935 | Van Voorst, Jr. | |
| 6,895,953 | B2 * | 5/2005 | Larsen et al. | 126/41 R |

* cited by examiner

*Primary Examiner* — Alfred Basichas

(74) *Attorney, Agent, or Firm* — Dority & Manning, P.A.

(57) ABSTRACT

A burner assembly for an oven appliance is provided. The burner assembly includes a gas burner and a flame spreader. The flame spreader defines a slot or a series of apertures that is substantially parallel to the gas burner. The slot or series of apertures can decrease a thickness of a boundary layer positioned adjacent the flame spreader or increase a velocity or a temperature or both of the boundary layer.

18 Claims, 4 Drawing Sheets

BURNER ASSEMBLY

FIELD OF THE INVENTION

The present subject matter relates generally to burner assemblies, e.g., for oven appliances.

BACKGROUND OF THE INVENTION

Oven appliances generally include a cabinet that defines a cooking chamber for receipt of food items for cooking. Heating elements are positioned within the cooking chamber to provide heat to food items located therein. The heating elements can include a bake heating element positioned at a bottom of the cooking chamber and/or a broil heating element positioned at a top of the cooking chamber. The heating elements can be gas burners that burn a combustible gas within the cooking chamber in order to provide heat to food items located therein.

In oven appliances with gas burners, a flame spreader is generally mounted above the gas burners in order to facilitate uniform heat distribution within the cooking chamber. In particular, the flame spreader can increase in temperature during operation of the oven appliance and provide a significant source of radiative heat to food items within the cooking chamber. Heated gases generated by the gas burners can provide the heat needed to increase the temperature of the flame spreader. However, a boundary layer of relatively cool air positioned adjacent the flame spreader can hinder convective heat transfer between the gas burner's heated gases and the flame spreader.

The thickness of the boundary layer and the velocity and temperature profiles of the boundary layer can affect convective heat transfer between the gas burner's heated gases and the flame spreader. In general, a relatively thinner boundary layer and a relatively high speed boundary layer can facilitate increased convective heat transfer. Also, facilitating direct contact between the gas burner's heated gases and the flame spreader can improve heat transfer therebetween.

Accordingly, a flame spreader with features for decreasing a thickness of a boundary layer positioned adjacent the flame spreader would be useful. In addition, a flame spreader with features for increasing a velocity or a temperature or both of a boundary layer positioned adjacent the flame spreader would be useful.

BRIEF DESCRIPTION OF THE INVENTION

The present subject matter provides a burner assembly for an oven appliance. The burner assembly includes a gas burner and a flame spreader. The flame spreader defines a slot or a series of apertures that is substantially parallel to the gas burner. The slot or series of apertures can decrease a thickness of a boundary layer positioned adjacent the flame spreader or increase a velocity or a temperature or both of the boundary layer. Additional aspects and advantages of the invention will be set forth in part in the following description, or may be apparent from the description, or may be learned through practice of the invention.

In a first exemplary embodiment, a burner assembly for an oven appliance is provided. The burner assembly includes a gas burner that extends longitudinally from a first end portion to a second end portion. A flame spreader has a heating surface positioned adjacent the gas burner. The flame spreader defines a slot that extends substantially parallel to the gas burner.

In a second exemplary embodiment, a burner assembly for an oven appliance is provided. The burner assembly includes a gas burner that extends longitudinally from a first end portion to a second end portion. A flame spreader having a heating surface positioned adjacent the gas burner is also provided. The flame spreader defines a series of apertures that is positioned substantially parallel to the gas burner.

In a third exemplary embodiment, an oven appliance is provided. The oven appliance includes a cabinet that defines a cooking chamber for receipt of food items for cooking. A burner assembly is mounted within the cooking chamber of the cabinet. The burner assembly includes a gas burner. A flame spreader has a heating surface positioned adjacent the gas burner. The burner assembly also includes means for reducing a thickness of boundary layer of air adjacent the heating surface of the flame spreader.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
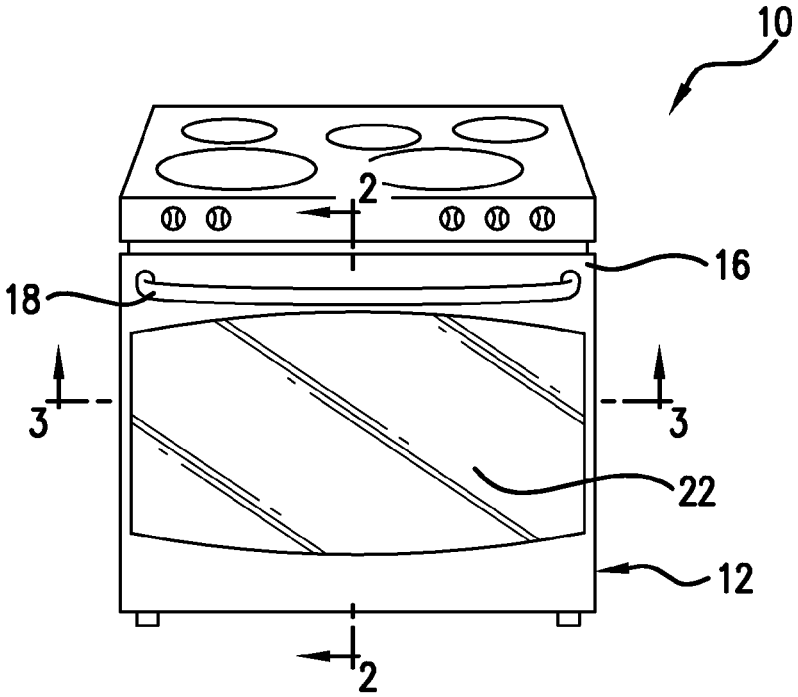
FIG. 1 provides a front perspective view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
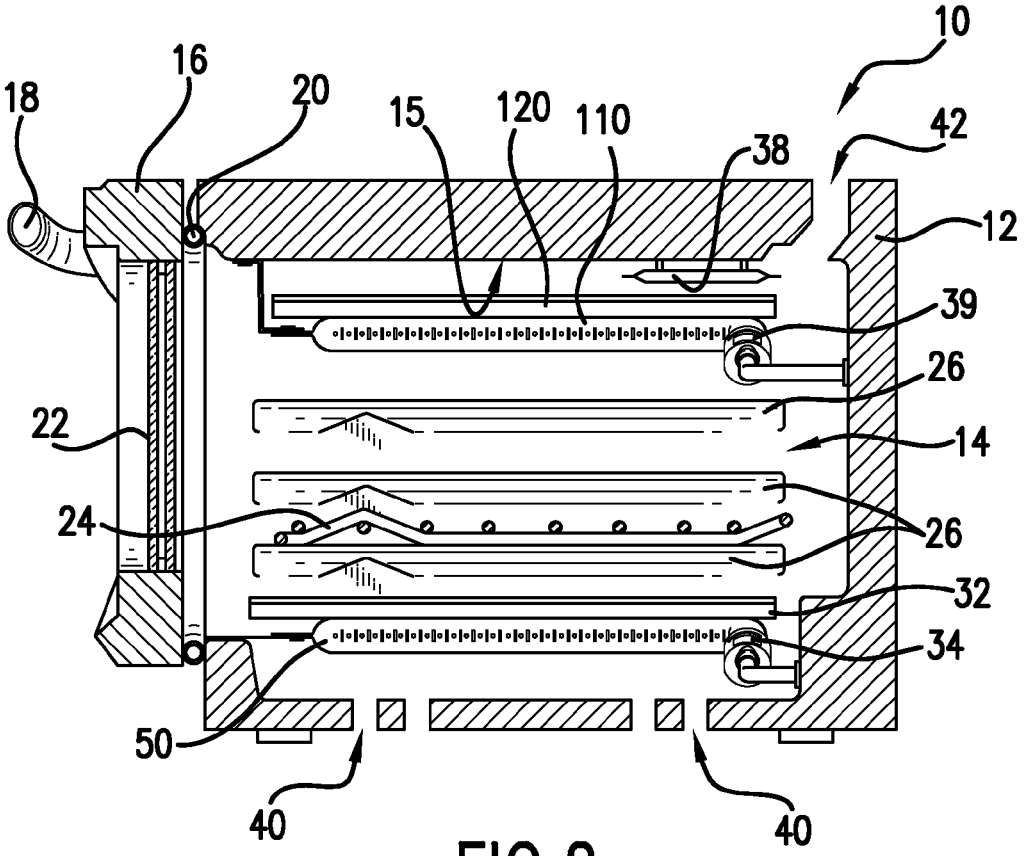
FIG. 2 illustrates a side, partial cross-sectional view of the oven appliance of FIG. 1.

FIGS. 1 and 2 illustrate an exemplary embodiment of a gas oven appliance 10. However, oven appliance 10 shown in FIGS. 1 and 2 is provided by way of example only. The present subject matter may be used with other oven appliance configurations such as wall oven appliances or stand-alone oven appliances. In addition, the present subject matter may be used with oven appliances that define multiple interior cavities for the receipt of food and/or having different pan or rack arrangements than what is shown in FIG. 2. Still other configurations may also be used as will be understood by one of skill in the art using the teachings disclosed herein. The present subject matter may be used with other appliances, e.g., a grill appliance or a water heater.

Oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 hingedly attached to cabinet 12, e.g., with a hinge (not shown). A handle 18 is mounted to door 16 and assists a user with opening and closing door 16 in order to access cooking chamber 14. For example, a user can pull on handle 18 to open or close door 16 and access cooking chamber 14. Cabinet 12 also defines inlets 40 and a vent 42. Fresh air from an exterior of cabinet 12 may enter cooking chamber 14 through inlets 40. Heated air and fumes from combustion of gas fuel may exit cooking chamber 14 through vent 42.

Seal 20 provides for maintaining heat and cooking fumes within cooking chamber 14 when door 16 is closed as shown in FIG. 2. Multiple parallel glass panes 22 provide for viewing the contents of cooking chamber 14 when door 16 is closed and assist in insulating cooking chamber 14. A baking rack 24 is positioned in cooking chamber 14 for the receipt of food items or utensils containing food items. Baking rack 24 is slidably received onto embossed ribs or sliding rails 26 such that rack 24 may be conveniently moved into and out of cooking chamber 14 when door 16 is open.

A gas fueled, bottom heating element 50 (e.g., a gas burner or a bake gas burner) is positioned in cabinet 12 below a bottom flame spreader 32. Bottom heating element 50 is used to heat cooking chamber 14 for both cooking and cleaning of oven appliance 10. A shutter 34 allows for the adjustment of air flow to feed the combustion of fuel. The size and heat output of bottom heating element 50 can be selected based on the e.g., the size of oven appliance 10.

A gas fueled, top heating element 110 is also positioned in cooking chamber 14 of cabinet 12 (e.g., a broil gas burner) below a top flame spreader 120. Top heating element 110 is used to heat cooking chamber 14 for both cooking/broiling and cleaning of oven appliance 10. An additional shutter 39 allows for the adjustment of air and/or fuel mixture to support the combustion of fuel. Like bottom heating element 50, the size and heat output of top heating element 110 can be selected based on the e.g., the size of oven appliance 10. In alternative embodiments, an electric, microwave, halogen, or any other suitable heating element may be used instead of gas heating element 110.

The operation of oven appliance 10 including heating elements 50 and 110 is controlled by one or more processing devices (not shown) such as a microprocessor or other device that is in communication with such components. Such processing device (used herein to refer generally to single and/or multiple processing devices) is also in communication with a temperature sensor 38 that is used to measure temperature inside cooking chamber 14 and provide such measurements to the process device. Temperature sensor 38 is shown (in FIG. 2) in the top and rear of cooking chamber 14. However, other locations may be used and, if desired, multiple temperature sensors may be applied as well.

Figure 3:
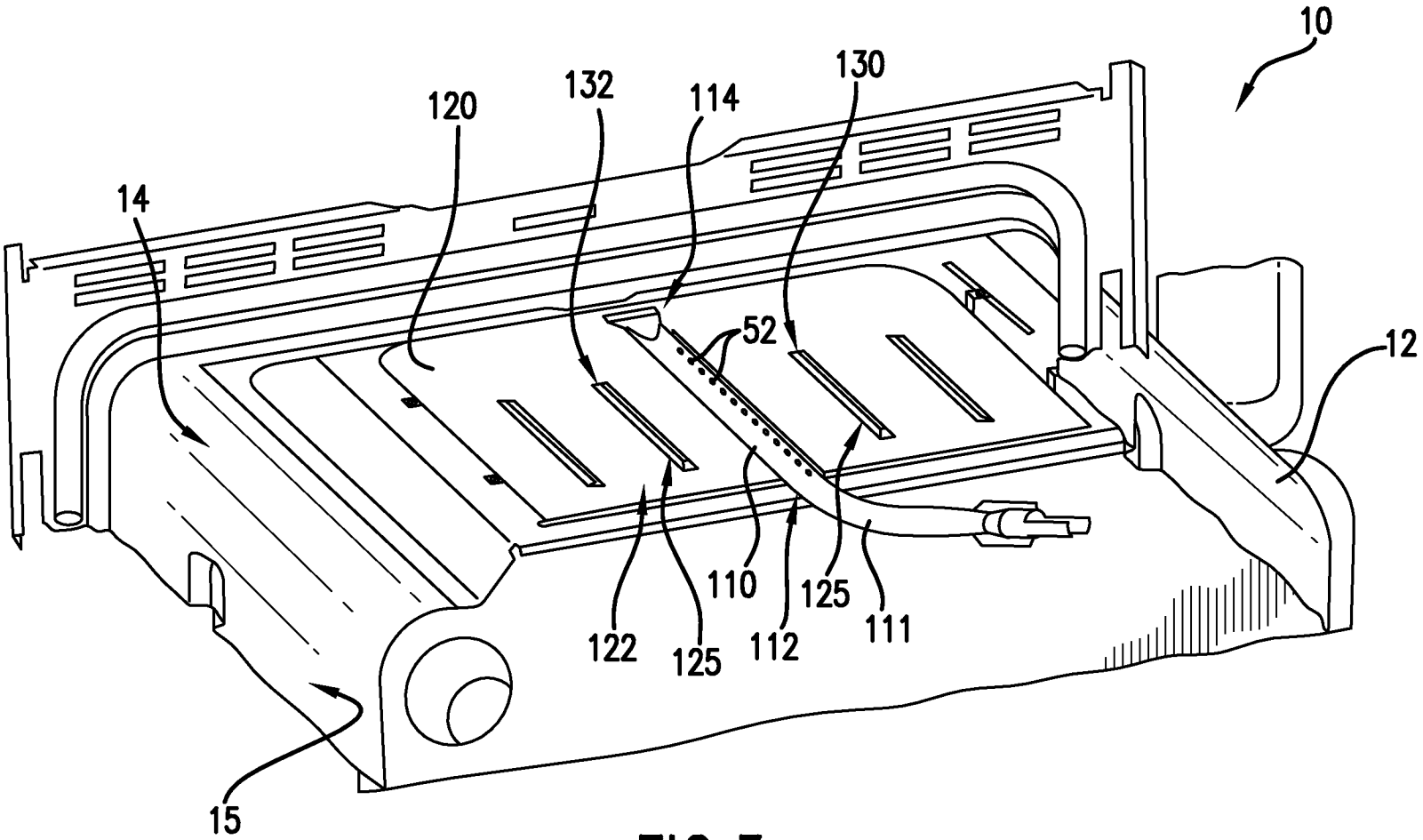
FIG. 3 provides a perspective, section view of the oven appliance of FIG. 1 taken along the 3-3 line of FIG. 1.

FIG. 3 provides a perspective, section view of oven appliance 10 taken along the 3-3 line of FIG. 1. FIG. 3 shows top heating element 110 and top flame spreader 120 mounted on interior surface 15 of cabinet 12. In particular, top flame spreader 120 is mounted on interior surface 15 of cabinet 12, and top heating element 110 is mounted to top flame spreader 120.

Top heating element 110 has a tubular body 111 and extends longitudinally between a first portion 112 and a second portion 114. In the exemplary embodiment shown in FIG. 3, top heating element 110 is substantially linear between first portion 112 and a second portion 114. However, in alternative exemplary embodiments, top heating element 110 may have any suitable shape. For example, top heating element 110 may be U-shaped or have an arcuate or circular shape. Similarly, bottom heating element 50 may have any suitable shape.

Top flame spreader 120 (and/or bottom flame spreader 32) is configured for facilitating uniform distribution of heat within cooking chamber 14 during operation of oven appliance 10. Combustible gases may flow through top heating element 110 and exit top heating element 110 through a plurality of passages 52 defined by top heating element 110. Outside of plurality of passages 52, such combustible gases may be burned in order to generate heat within cooking chamber 14, e.g., to cook food items located therein. Such burning can also heat up top flame spreader 120.

In particular, top flame spreader 120 has a heating surface 122 that faces and is positioned adjacent top heating element 110. Thus, top heating element 110 is positioned below top flame spreader 120. Convective heat transfer from heated flue gases of top heating element 110 can increase the temperature of heating surface 122 of top flame spreader 120 during operation of oven appliance 10. As top flame spreader 120 increases in temperature, radiant heat transfer from top flame spreader 120 to cooking chamber 14 increases as well. Such radiant heat transfer can provide improved uniformity of heat transferred into cooking chamber 14. Bottom flame spreader 32 and bottom heating element 50 can operate in a similar manner.

However, a boundary layer of relatively cool air positioned adjacent top flame spreader 120, e.g., on heating surface 122, can hinder convective heat transfer to top flame spreader 120. Thus, bottom flame spreader 32 and top flame spreader 120 may include features for decreasing a thickness of the boundary layer or for increasing a velocity or a temperature or both of the boundary layer. Such features can facilitate heat transfer to bottom flame spreader 32 and/or top flame spreader 120 and more uniform cooking of food items located within cooking chamber 14. Such features are discussed in greater detail below.

Figure 4:
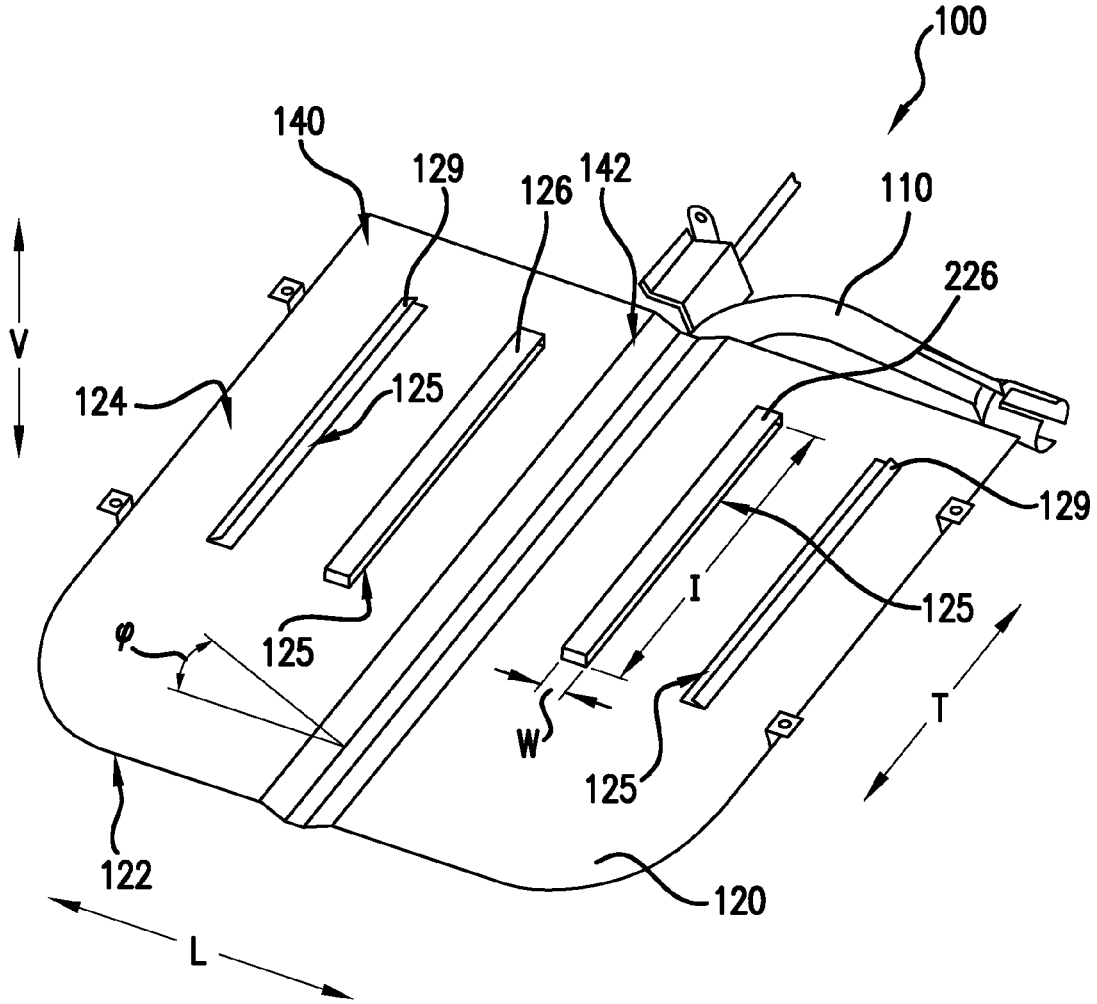
FIG. 4 is a top, perspective view of a burner assembly according to an exemplary embodiment of the present subject matter. The burner assembly includes a flame spreader and a gas burner.

FIG. 4 is a top, perspective view of a burner assembly 100 according to an exemplary embodiment of the present subject matter. Burner assembly 100 includes top flame spreader 120 and top heating element 110. Bottom flame spreader 32 and bottom heating element 50 of oven appliance 10 may be configured in a similar manner. As may be seen in FIG. 4, burner assembly 100 defines a vertical direction V, a lateral direction L, and a transverse direction T. The vertical, lateral, and transverse directions V, L, and T are mutually perpendicular and form an orthogonal direction system.

As may be seen in FIG. 4, heating surface 122 of top flame spreader 120 comprises a first portion 140 and a second portion 142 that define an angle $\phi$ therebetween. Angle $\phi$ may be greater than about five degrees and less than about seventy degrees. By proving heating surface 122 with first portion 140 and second portion 142, heated flue gases from top heating element 110 may be urged to spread across heating surface 122 of top flame spreader 120 in order to more uniformly distribute heat across heating surface 122 of top flame spreader 120 as will be understood by those skilled in the art.

Top flame spreader 120 defines a plurality of slots 125 that extends substantially parallel to top heating element 110, e.g., from first portion 112 to second portion 114 of top heating element 110. In particular, top flame spreader 120 has an exterior surface 124 that is positioned opposite heating surface 122. Slots 125 extends through top flame spreader 120 from heating surface 122 of top flame spreader 120 to exterior surface 124 of top flame spreader 120, e.g., along the vertical direction V. In FIG. 4, top flame spreader 120 defines four slots. However, in alternative exemplary embodiments, top flame spreader 120 may define any suitable number of slots, e.g., one, two, three, five, or more slots.

A shown in FIG. 4, slots 125 have a length I, e.g., along the transverse direction T and a width W, e.g., along the lateral direction L. The length I and width W may be any suitable dimension. In particular, the length I may be about two, four, six, eight, ten, or more inches. Conversely, the width W may be about one quarter, one half, or one inch. A ratio between length I and width W may be about 2:1, 4:1. 6:1, 8:1, 10:1, or 20:1.

Slots 125 permit some portion of heated air within cooking chamber 14 of oven appliance 10 (FIG. 2), e.g., a portion of the heated flue gases from top heating element 110, to pass through top flame spreader 120 between heating surface 122 and exterior surface 124. Slots 125 can also reduce the thickness of the boundary layer or increase a velocity or a temperature or both of the boundary layer as discussed above. In particular, a portion of heated flue gases from top heating element 110 can flow across heating surface 122 and can pass through slots 125 rather than stagnate on heating surface 122. Thus, slots 125 can increase a velocity of heated flue gases from top heating element 110 across heating surface 122 and/or facilitate direct contact between heated flue gases from top heating element 110 and heating surface 122 in order to increase heat transfer therebetween.

Deflectors 126 are mounted to top flame spreader 120. Deflectors 126 are positioned adjacent exterior surface 124 of top flame spreader 120 and at slots 125 of top flame spreader 120. Louvers 129 are also mounted to top flame spreader 120. Louvers 129 are positioned adjacent slots 125 of top flame spreader 120, e.g., on heating surface 122 and/or exterior surface 124 of top flame spreader 120. Louvers 129 may be configured for regulating or directing a flow of air through slots 125.

In FIG. 4, deflectors 126 are mounted at two slots 125 and louvers 129 are mounted at two other slots 125. However in alternative exemplary embodiments, top flame spreader 120 may include any suitable number of deflectors 126 and louvers 129. For example, top flame spreader 120 may include only deflectors 126 or only louvers 129 or any suitable combination of the same. In additional alternative exemplary embodiments, top flame spreader 110 need not include any deflectors 126 and/or louvers 129.

Figure 5:
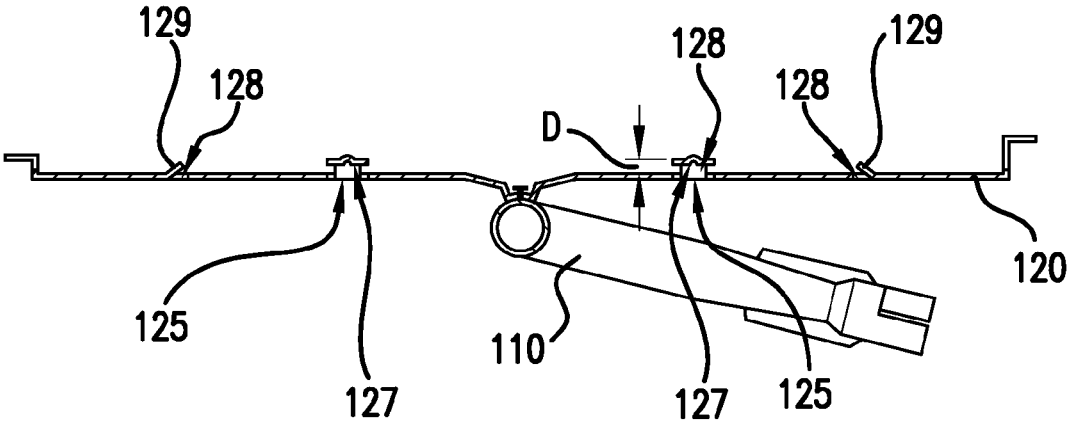
FIG. 5 is a section view of the flame spreader and gas burner of FIG. 4.

FIG. 5 is a section view of top flame spreader 120 and top heating element 110. Deflectors 126 have a cooking surface 127 that is spaced apart from exterior surface 124 of top flame spreader 120 by about a distance D, e.g., along the vertical direction V. Distance D may be any suitable distance. For example, distance D may be less than about one inch, one half of an inch, one quarter of an inch, or one eighth of an inch.

Like heating surface 122 of top flame spreader 120, cooking surface 127 of deflectors 126 can heat up during operation of oven appliance 10 and direct radiant heat energy to food items within cooking chamber 14. Thus, providing deflectors 126 can facilitate uniform heat distribution throughout cooking chamber 14 relative to slots 125 without deflectors 126. In particular, heating surface 122 of top flame spreader 120 and cooking surface 127 of deflectors 126 collectively provide a total radiant heating surface that faces cooking chamber 14 and directs heat to food items within cooking chamber 14. Louvers 129 can also provide similar surface area for heating of food items.

Slots 125 of top flame spreader 120 each have an outlet 128 on exterior surface 124 of top flame spreader 120. Outlet 128 has an area. Similarly, each cooking surface 127 of deflectors 126 has an area. The area of cooking surface 127 is about equal to or larger than the area of outlet 128. Thus, the total radiant heating surface of top flame spreader 120 can be maximized relative to deflectors 126 with smaller cooking surfaces 127.

Louvers 129 may be rotatably or adjustably mounted to top flame spreader 120. Thus, louvers 129 can selectively hinder or obstruct a flow of air through slots 125, e.g., by rotating open and closed. In particular, louvers 129 can selectively adjust the size of outlet 128 of slots 125.

Turning back to FIG. 3, top heating element 110 comprises a first portion 112 and a second portion 114, e.g., that are spaced apart along at least one of the lateral and transverse directions. Further, slots 125 of top flame spreader 120 may include a first slot 130 and a second slot 132. In the exemplary embodiment shown in FIG. 3, first portion 112 and second portion 114 are spaced apart along the transverse direction T, and top heating element 110 is positioned between first slot 130 and second slot 130, e.g., along at least one of the lateral and transverse directions L and T. Conversely, in oven appliances with a U-shaped top heating element, first portion 112 and second portion 114 may be spaced apart along the lateral direction L because top heating element 110 is U-shaped. Thus, first and second slots 130 and 132 may be positioned between first and second portions 112 and 114 of top heating element 110, e.g., along the lateral direction L.

As will be understood by those skilled in the art, slots 125 need not comprise a single continuous opening. In particular, slots 125 may comprise a series of apertures. Thus, rather than a single continuous opening as shown in FIG. 3, each slot 125 may comprise a series of discrete apertures that, e.g., extend parallel to top heating element 110.

Figure 6:
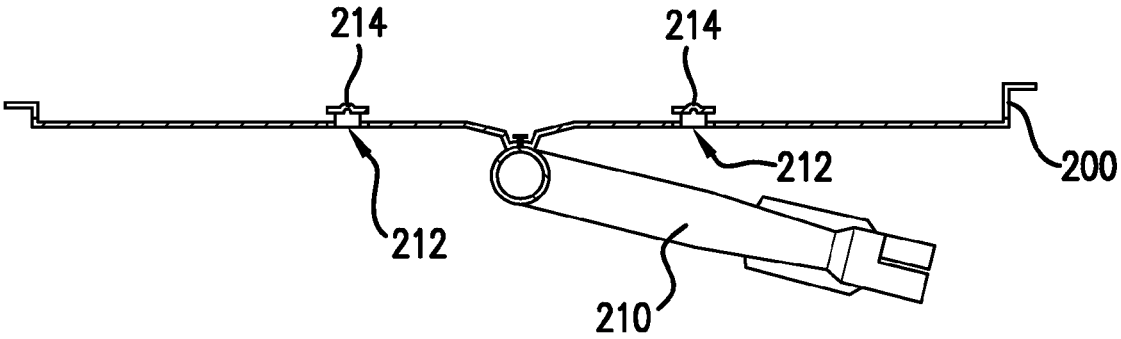
FIG. 6 is a section view of a flame spreader and a gas burner according to additional exemplary embodiments of the present subject matter.

FIG. 6 is a section view of a flame spreader 200 and a gas burner 210 according to additional exemplary embodiments of the present subject matter. In FIG. 6, flame spreader 200 defines only two slots 212. Deflectors 214 are mounted at slots 212. However, flame spreader 200 does not include louvers.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A burner assembly defining a lateral direction and a transverse direction, the lateral and transverse directions being perpendicular to each other, the burner assembly comprising:

a gas burner that extends between a first end portion and a second end portion along the transverse direction; and a flame spreader having a heating surface positioned adjacent said gas burner, said flame spreader defining a first slot and a second slot that each extend along the transverse direction substantially parallel to said gas burner, the first and second slots of said flame spreader each defining a width along the lateral direction and a length along the transverse direction, a ratio of the length of the fit slot to the width of the first slot being no less than eight to one, a ratio of the length of the second slot to the width of the second slot being no less than eight to one, said gas burner positioned between the first slot and the second slot along the lateral direction.

2. The burner assembly of claim 1, wherein said flame spreader also has a back surface positioned opposite the heating surface of said flame spreader, wherein the first and second slots extend through said flame spreader from the heating surface of said flame spreader to the back surface of said flame spreader.

3. The burner assembly of claim 2, further comprising a deflector mounted to said flame spreader and positioned adjacent the back surface of said flame spreader, said deflector positioned at the first slot of said flame spreader.

4. The burner assembly of claim 3, wherein the deflector has a cooking surface that is spaced apart from the back surface of said flame spreader by about a distance, the distance being less than about one half of an inch.

5. The burner assembly of claim 3, wherein the first slot of said flame spreader has an outlet on the back surface of said flame spreader, the outlet of the first slot having an area, wherein the deflector has a cooking surface that faces the back surface of said flame spreader, the cooking surface having an area that is about equal to or larger than the area of the outlet of the first slot.

6. The burner assembly of claim 1, further comprising a louver positioned adjacent the first slot of said flame spreader, said louver configured for regulating a flow of air through the first slot of said flame spreader.

7. The burner assembly of claim 1, wherein said gas burner comprises a first portion and a second portion that are spaced apart along at least one of the lateral and transverse directions, wherein the first slot is positioned adjacent the first portion of said gas burner and the second slot is positioned adjacent the second portion of said gas burner.

8. The burner assembly of claim 1, wherein the heating surface of said flame spreader comprises a first portion and a second portion that define an angle $\phi$ therebetween, the angle $\phi$ being greater than about five degrees and less than about seventy degrees.

9. The burner assembly of claim 1, wherein the gas burner defines a plurality of flame ports between the first and second end portions of said gas burner, the first and second slots of said flame spreader extending along the transverse direction such that the first and second slots of said flame spreader are spaced apart from each flame port of the plurality of flame ports along the lateral direction.

10. The burner assembly of claim 1, wherein the length of the first and second slots is greater than six inches and the width of the first and second slots is greater than a quarter of an inch.

11. The burner assembly of claim 1, wherein the first and second slots of said flame spreader are spaced apart from said gas burner along the lateral direction such that the slot of said flame spreader permits heated flue gases from said gas burner to pass through said flame spreader.

12. A burner assembly defining a lateral direction and a transverse direction, the lateral and transverse directions being perpendicular to each other, the burner assembly comprising:

a gas burner that extends between a first end portion and a second end portion along the transverse direction; and a flame spreader having a heating surface positioned adjacent said gas burner, said flame spreader defining a first series of apertures and a second series of apertures, the first and second series of apertures distributed such that the first and second series of apertures are both substantially parallel to said gas burner along the transverse direction, the first and second series of apertures of said flame spreader distributed between the first and second end portions of said gas burner along the transverse direction, said gas burner positioned between the first and second series of apertures of said flame spreader along the lateral direction.

13. The burner assembly of claim 12, wherein said flame spreader also has a back surface positioned opposite the heating surface of said flame spreader, wherein each aperture of the first and second series of apertures extends through said flame spreader from the heating surface of said flame spreader to the back surface of said flame spreader.

14. The burner assembly of claim 13, further comprising a deflector mounted to said flame spreader and positioned adjacent the back surface of said flame spreader, said deflector positioned adjacent the first series of apertures of said flame spreader.

15. The burner assembly of claim 14, wherein said deflector has a cooking surface that is spaced apart from the back surface of said flame spreader by about a distance, the distance being less than about one half of an inch.

16. The burner assembly of claim 15, wherein each aperture of the first series of apertures of said flame spreader has an outlet on the back surface of said flame spreader, the outlets of the first series of apertures having an area, wherein the deflector has a cooking surface that faces the back surface of said flame spreader, the cooking surface having an area that is about equal to or larger than the area of the outlets of the first series of apertures.

17. The burner assembly of claim 12, further comprising a louver, the louver positioned adjacent the first series of apertures of said flame spreader, the louver configured for regulating a flow of air through the first series of apertures of said flame spreader.

18. The burner assembly of claim 12, wherein the heating surface of said flame spreader comprises a first portion and a second portion that define an angle $\phi$ therebetween, the angle $\phi$ being greater than about five degrees and less than about seventy degrees.

* * * * *